US007594543B2

(12) United States Patent
Goncalves et al.

(10) Patent No.: US 7,594,543 B2
(45) Date of Patent: Sep. 29, 2009

(54) METHOD AND APPARATUS FOR PRODUCTION IN OIL WELLS

(76) Inventors: Marcelo de Albuquerque Lima Goncalves, Rua das Laranjeiras, 457 - Bloco A - ap. 606 - Laranjeiras, Rio de Janeiro, Cep 22240-002 (BR); Odair Geraldo dos Santos, Rua Artistides Fraga, Lima, 385 ap. 502 Ed. Solar de Parati, Cep 47454-000, Loteamento Aquarius - Pituba - Salvador - BA (BR); Alcino Resende De Almeida, Rua Maris e Barros, 572 ap. 505 - Tijuca, Cep 20270-001 Rio de Janeiro (BR)

( * ) Notice: Subject to any disclaimer, the term of this patent is extended or adjusted under 35 U.S.C. 154(b) by 346 days.

(21) Appl. No.: 10/918,282

(22) Filed: Aug. 14, 2004

(65) Prior Publication Data

US 2007/0187110 A1 Aug. 16, 2007

(30) Foreign Application Priority Data

Aug. 14, 2003 (BR) ..... 0303129-2

(51) Int. Cl.
*E21B 33/035* (2006.01)

(52) U.S. Cl. ..... 166/372; 166/106

(58) Field of Classification Search ..... 166/352, 166/369, 372, 8, 68.5, 105, 106
See application file for complete search history.

(56) References Cited

U.S. PATENT DOCUMENTS

| | | | | |
|---|---|---|---|---|
| 3,987,852 | A * | 10/1976 | Terry | 166/261 |
| 4,848,471 | A * | 7/1989 | Bencze | 166/335 |
| 6,336,503 | B1 * | 1/2002 | Alhanati et al. | 166/265 |
| 6,341,654 | B1 * | 1/2002 | Wilson et al. | 166/387 |
| 6,651,742 | B2 * | 11/2003 | Burd et al. | 166/269 |
| 2001/0007283 | A1 * | 7/2001 | Johal et al. | 166/265 |
| 2005/0167116 | A1 * | 8/2005 | Lima Goncalves et al. | 166/352 |

* cited by examiner

*Primary Examiner*—William P Neuder
(74) *Attorney, Agent, or Firm*—TraskBritt

(57) ABSTRACT

The present invention relates to an apparatus and method for production from oil wells. More particularly, the present invention relates to an apparatus that utilizes at least one injection pumping device (9), positioned in the interior of a petroleum well (10) to provide hydraulic fluid to a hydraulic pumping device (3) positioned in the bottom of the petroleum well (10), in order to cause a flow of fluids originating from a reservoir (14).

20 Claims, 13 Drawing Sheets

METHOD AND APPARATUS FOR PRODUCTION IN OIL WELLS

BACKGROUND OF THE INVENTION

1. Field of the Invention

The instant invention relates to an apparatus for production from oil wells. More particularly, the present invention relates to an apparatus that utilizes at least one injection pump, positioned in proximity to a subsea petroleum well, to provide hydraulic fluid for hydraulic pumping device positioned in the bottom of the well, in order to cause a flow of produced oil.

2. State of the Art

The process of petroleum production includes the flow from a geological formation or reservoir, positioned at some hundreds or perhaps some thousands of meters below the surface, to installations positioned on the surface.

In the beginning of production from a reservoir the natural pressure normally is sufficient to establish the drainage of oil towards the surface. Thereafter, owing to the degree that the oil reserves of the reservoir are being exploited with the consequent diminution of pressure from the reservoir, it becomes necessary to employ a method for pumping the fluid from the well towards the surface, this operation is known as "an artificial lifting of petroleum."

Some methods for lifting the petroleum from the well are known, for example, a pneumatic pump (also known in English as a "gas lift"), the use of bottom pumps, that maybe either of a centrifugal or reciprocating type.

The selection of the type of artificial petroleum lifting that will be utilized is done as a function of the characteristics of the well, its fluid and the available resources at the production site.

One of the available methods of lifting is the hydraulic jet pump (HJP) also known in English as "jet pumping". In the present description, for the sake of simplification, this method will hereinafter be referred to simply as HJP.

The operational principle of the HJP is similar to that of ejectors, of the type usually found in processing plants. Basically, this system of production includes a tank for storage of hydraulic fluid, a hydraulic fluid injection pump, an ejector or injection pump and a separating vessel. Among these elements, only the ejector, is located in the interior of the well.

The hydraulic fluid may to be different from the produced oil and is pumped at high pressure toward the interior of the well by an injection pump. In the location in which the ejector is installed, in the bottom of the well, the hydraulic fluid is forced to flow through a restriction which includes an injection nozzle.

With this, a transformation occurs of pressure energy to kinetic energy, in conformance to the first law of Thermodynamics. In the suction of the ejector, which is a point of low pressure, an entry of fluid, provided by the reservoir, occurs, due to the suction effects caused by the low pressure in the nozzle.

Soon thereafter, downstream of this point, there is a narrowing of the flow path, e.g. a throat, where an effective mixing of the hydraulic fluid and the fluid, provided from the reservoir, occurs. This results in the formation of a single fluid flow.

Thereafter, this fluid flow passes through a diffuser, where the area of flow increases gradually, which causes a transformation of the kinetic energy into energy of pressure, and with this the mixture of oil, provided from the formation and the hydraulic fluid flow toward the surface.

The HJP has the following application advantages:

a) There are no moving parts in the interior of the well, which results in a device having great durability;
b) In certain configurations the bottom pump may be recovered by a reverse flow, thereby avoiding any necessity of an intervening operation in the well to replace the pump;
c) An easy injection of chemical products, such as corrosion inhibitors is made possible;
d) In the case of a reservoir which produces heavy oil, one may utilize the hydraulic fluid to reduce the viscosity of the fluid produced by the reservoir by either diluting it, if a lighter oil is used as a hydraulic fluid, or by forming an inverse emulsion, if water is used as a hydraulic fluid.
e) It exhibits a good tolerance to sand and gas.

On the other hand, HJP presents some disadvantages which may be distinguished as follows:

a) Low energy efficiency which requires a larger consumption of energy for its operation in comparison with other methods of artificial petroleum lifting. On the other hand, for petroleum wells, especially subsea wells, this factor is not relevant because in these situations the cost of energy is very low when compared with the other operational costs of the other methods of artificial petroleum lifting, such as the cost of intervention to repair or replace pumps positioned in the bottom of the well;
b) If the hydraulic fluid is water, it is necessary to undergo a separation process in the installations on the surface which may significantly overload the processing system;
c) Since an addition of liquid occurs in the region where the ejector is located, there is a diminution in the fraction of gas and consequently an increase in the apparent average specific mass inside the column of production. As a consequence of this the required discharge pressure of the pump also increases, making the whole system, i.e. the well, the injection pump, the Christmas tree and flowlines, operate at high pressure. This particular aspect represents a great limitation in the use of the HJP, in that high operational pressures require device that is much more robust, more expensive, and subject to major risks of accidents and leakage.

In review, an analysis of this method indicates that the major benefit of the HJP relates to its durability, the fact that there are no moving parts in the interior of the well. On the other hand, its limitation for application is, in many cases, the high pressure required for the injection of the hydraulic fluid.

In the case of the petroleum well being an subsea well, the situation is more serious in that usually the distance between the location of the platform, on which the injection pump is installed, and the subsea wellhead is much larger, generally more than a kilometer. In this case there would be the inconvenience of having to provide a hydraulic conduit, of a considerable length which would be able to support elevated pressures. This would increase the costs and the operational risks.

A method of hydraulic pumping by way of a piston (HPP) is also known in the art In this method a reciprocating double action piston pump is connected through an actuated piston axle to a reciprocating double action piston hydraulic motor. The motor and the pump are similar in their constructive aspects.

Hydraulic fluid is fed to this system to actuate a reciprocating ascending/descending of the piston of the motor. This motor piston is connected to the piston of the pump and as a consequence the latter also effects reciprocating movements that are ascending and descending.

When the piston pump effects a descending movement, at that same time there will occur a suction of the fluid to be pumped, into the superior chamber of the pump. There will be a discharge of fluid through the lower chamber.

When the pump piston effects an ascending movement, the situation will be inverted and the suctioned fluid will then to be discharged, initiating in this moment a new entry of fluid into the lower chamber.

As may be observed the instant process is a cyclical process.

The use of hydraulic turbines in petroleum wells for actuating a rotative hydraulic pump is also known. Examples of such a use include methods of using submerged centrifugal pumps (SCP) and progressive cavity pumps (PCP).

In a SCP a hydraulic turbine actuates an axial centrifugal pump; alternatively an assembly of these pumps may be connected in series. In a PCP a turbine actuates a screw pump. These two methods are well known in the art and will not be described herein in view of their being well known by those skilled in the art.

In conclusion, every pumping system that utilizes reciprocating pumps or rotative pumps to drain a petroleum reservoir from a production well either by means of the use of a hydraulic motor or by means of the use of a hydraulic turbine will always suffer limitations in its operation due to the elevated pressures of the hydraulic fluid injection system.

The present invention provides an apparatus that solves the problems mentioned above related to the high pressure injection of hydraulic fluid required by hydraulic pumping device from the bottom of the well, as will be seen in the following.

BRIEF DESCRIPTION OF THE DRAWINGS

The invention will be described with reference to the annexed figures which form an integral part of the instant specification, which merely by way of illustration, depict preferred embodiments of the invention.

DETAILED DESCRIPTION OF THE INVENTION

Before beginning a description of the invention, reference will be made to FIG. 1, which is a schematic representation of a hydraulically actuated installation for artificially lifting petroleum. In this representation a hydraulic jet pump installation, well known in the art, is illustrated.

Figure 1:
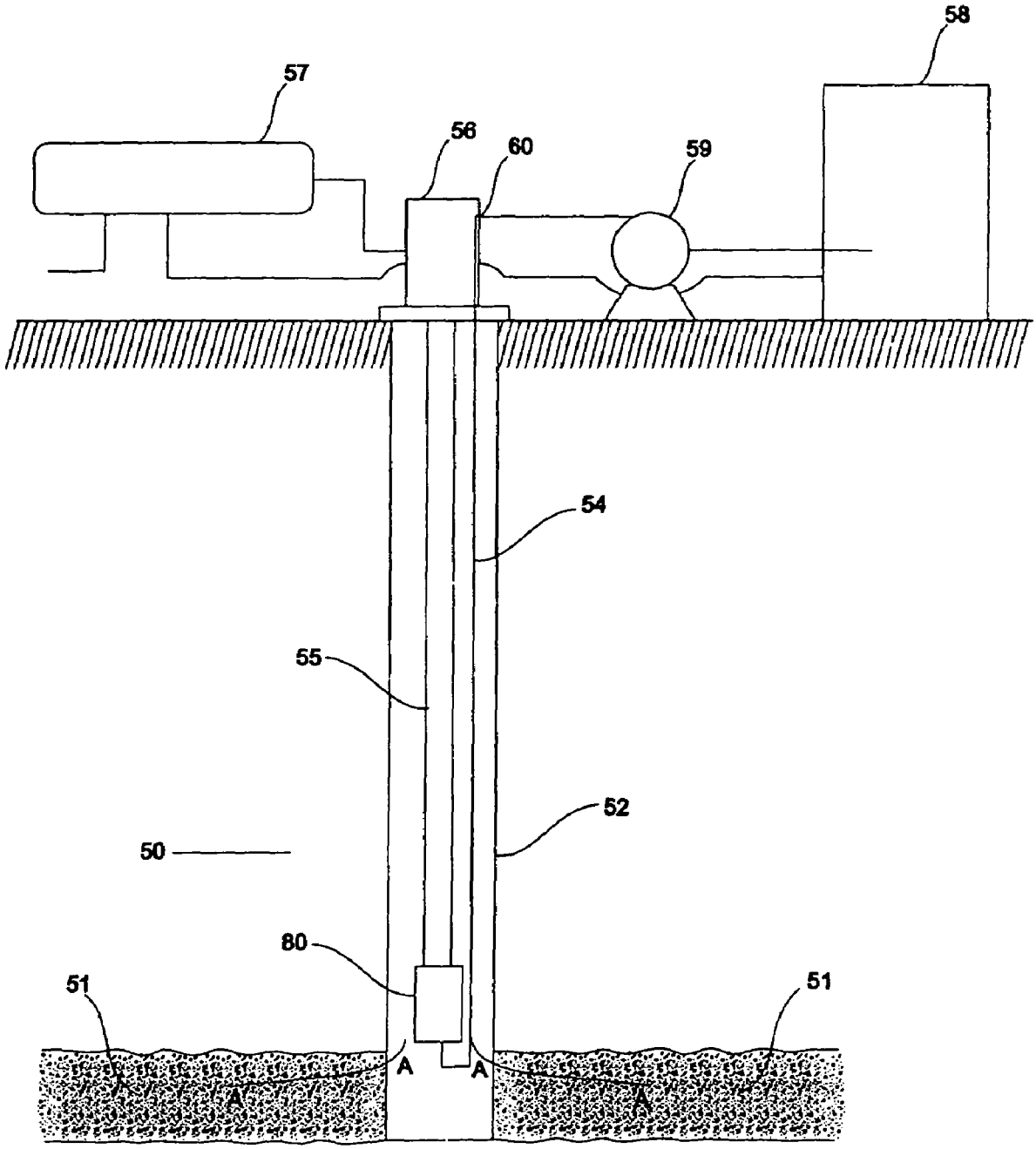
Fig. 1 Prior Art
FIG. 1 illustrates a schematic representation of an installation of a hydraulic jet pump in accordance with the known art.

In FIG. 1, an oil well 50 is shown provided with a casing 52. A production tubing 55 is installed in the interior of the casing 52.

At some point in the production tubing 55, preferentially in its lower end, hydraulic device 80 is installed. The hydraulic device 80 receives hydraulic fluid through a hydraulic fluid injection tubing 54 which originates from the surface.

The casing 52, the production tubing 55 and the hydraulic fluid injection tubing 54 are connected at their respective upper ends to the structure 56, known in the art as a Christmas tree. The Christmas tree will not be herein described in view of its being well known to those skilled in the art.

Figure 2:
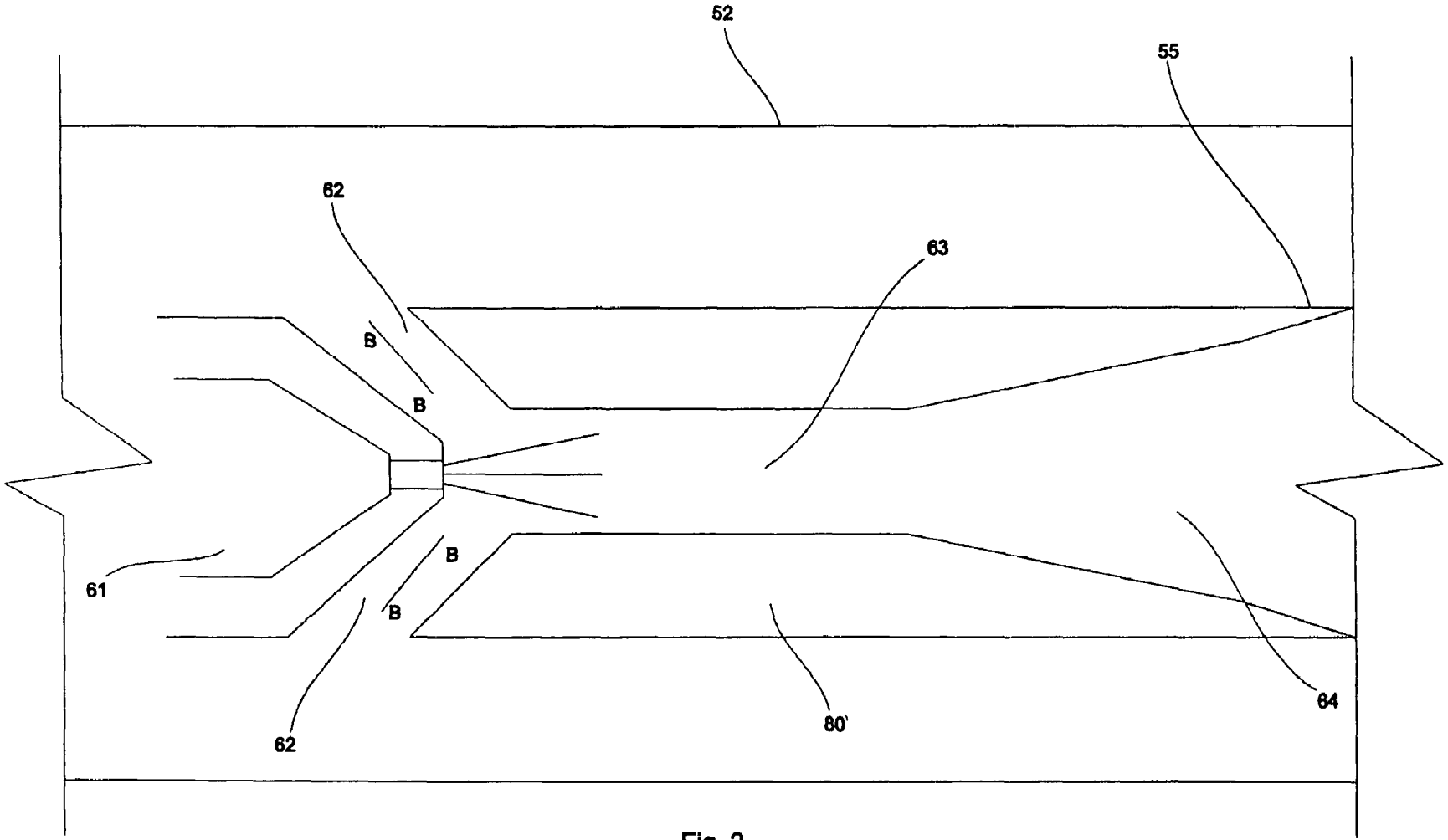
Fig. 2 Prior Art
FIG. 2 illustrates a schematic representation of an ejector device in accordance with the known art.

In the case of a hydraulic jet pump, the hydraulic device 80 is an ejector. In FIG. 2 an ejector device 80' is shown, the ejector 80' includes an ejector nozzle 61, suction channel 62, a throat 63, and a diffuser 64.

An injection pump 59 positioned on the surface sucks hydraulic fluid from a tank of hydraulic fluid 58 and pumps that fluid through a point of connection 60 in the Christmas tree 56 which is connected to hydraulic fluid injection tubing 54.

The flow of hydraulic fluid, pumped by the injection pump 59, is conducted through the hydraulic fluid injection tubing 54 to the injection nozzle 61 of the injection device 80'. Upon passing through the ejector nozzle 61, the flow of hydraulic fluid undergoes a choking.

At this point the flow of the hydraulic fluid undergoes a transformation wherein energy resultant from pressure is transformed into kinetic energy, with the flow of hydraulic fluid being then accelerated and subsequently ejected through the ejector nozzle 61 in the direction of the throat 63 as demonstrated by the arrows extending from the ejector nozzle 61 in FIG. 2. As a consequence, the fluids, originating from the petroleum reservoir 51, as represented by arrows A-A in FIG. 1, undergo a suction effect and are admitted to the interior of the throat 63 by way of the suction channel 62 as illustrated by arrows B-B in FIG. 2.

The fluids, produced from the petroleum reservoir 51, are mixed with the hydraulic fluid and the mixture then flows through the interior of the production tubing 55 to the Christmas tree 56 on the surface. Thereafter, this mixture of fluids is directed to a separation vessel 57 where a separation of the fluid mixture is undertaken. The hydraulic fluid is then returned to the tank of hydraulic fluid 58 in order to be reused.

Figure 3:
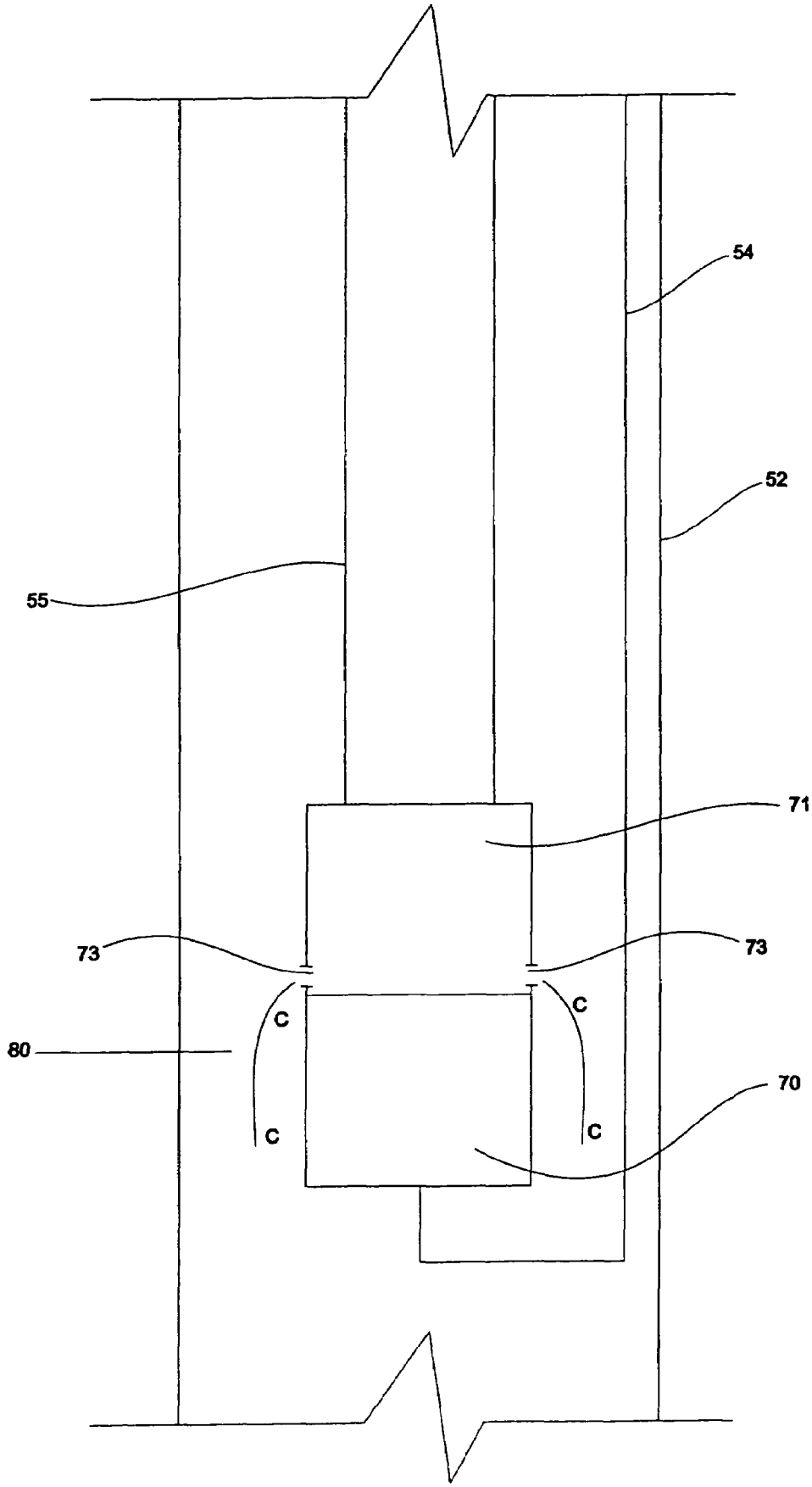
Fig. 3 Prior Art
FIG. 3 illustrates schematically a situation in which the employed method is a system of rotative actuation pumping.

FIG. 3 illustrates schematically a situation wherein the method utilized is not a HJP. Instead, a pumping system utilizing rotative actuation, e.g. a submersible centrifugal pump or a progressive cavity pump, may be used. In this situation, the device 80 includes a hydraulic motor or a hydraulic turbine 70 that actuates a pump 71 that may be a submersible centrifugal pump or a progressive cavity pump.

The hydraulic fluid pumped by the injection pump 59 is conducted through a hydraulic fluid injection tubing 54 to the hydraulic motor or hydraulic turbine 70. The hydraulic motor or hydraulic turbine 70 actuates the pump 71 by way of an actuation coupling, which is not illustrated in FIG. 3.

As a consequence, the fluids originating from the petroleum reservoir 51 undergo a suction effect and are then admitted into the interior of the pump 71 by way of a suction opening 73. The hydraulic fluid that leaves the hydraulic motor or the hydraulic turbine 70 is also conducted by a pump 71 by way of tubing 72.

The fluids produced from the petroleum reservoir 51 also mix with the hydraulic fluid and the mixed fluids flow from the interior of the production tubing 55 to the Christmas tree 56 on the surface. This mixture of fluids is also conducted to a separation vessel 57 where a separation of the mixed fluids is effected. The hydraulic fluid is then returned to the tank of hydraulic fluid 58 in order to be reutilized.

As was previously mentioned, it is also possible to utilize a method of hydraulic piston pump (HPP) wherein a dual action piston pump is connected through the actuation axle of the piston, to an alternative dual action piston hydraulic motor.

Hydraulic fluid is provided by an injection pump, positioned on the surface, to the alternative hydraulic motor, which effectuates ascending/descending movements that are transmitted to the pump, which produces a pumping effect, directed towards the surface, on the oil produced in the petroleum reservoir 51.

Usually, an injection pump 59 is installed in a location proximate to the tank of hydraulic fluid 58, irrespective of whether a HJP, SCP, PCP, or HPP is used. As a consequence, the injection pump is positioned at a considerable distance from the petroleum reservoir. This is especially common in situations where there are various wells that operate utilizing the methods previously mentioned and all of the wells are fed by a single injection pump.

It is also known in the art to use an injection pump, positioned in a service unit, to feed diverse wells, including some with dry completion, that is, with the Christmas tree positioned in the service unit, and others with wet completion, that is, with a subsea Christmas tree positioned on the seabed.

In this type of configuration, all of the injection system, downstream of the injection pump, is subjected to elevated pressures, which increases the risk of accidents and consequential interruptions in operation.

There are situations in which the injection pressure, necessary for the operation of wells, is so high that the usual tubing is unable to withstand such pressures. In this case, it is necessary to use specialized tubing, the cost of which is so expensive that it renders the use of such tubing economically unfeasible.

Situations may also occur in which such tubing is not commercially available on the market. This in turn makes it necessary to special order such tubing, which contributes even more so to increasing the costs.

Therefore, in the situation in which there are various wells that produce utilizing the methods previously mentioned, all of which are fed by a single injection pump, the difficulties previously described would lead one to discard prematurely, as not constituting a technical and economically viable option, the use of HJP or the use of a motor or hydraulic turbine in order to actuate a pump positioned in the interior of the column and proximate to the petroleum reservoir as is the case of SCP, PCP, or HPP.

Figure 4:
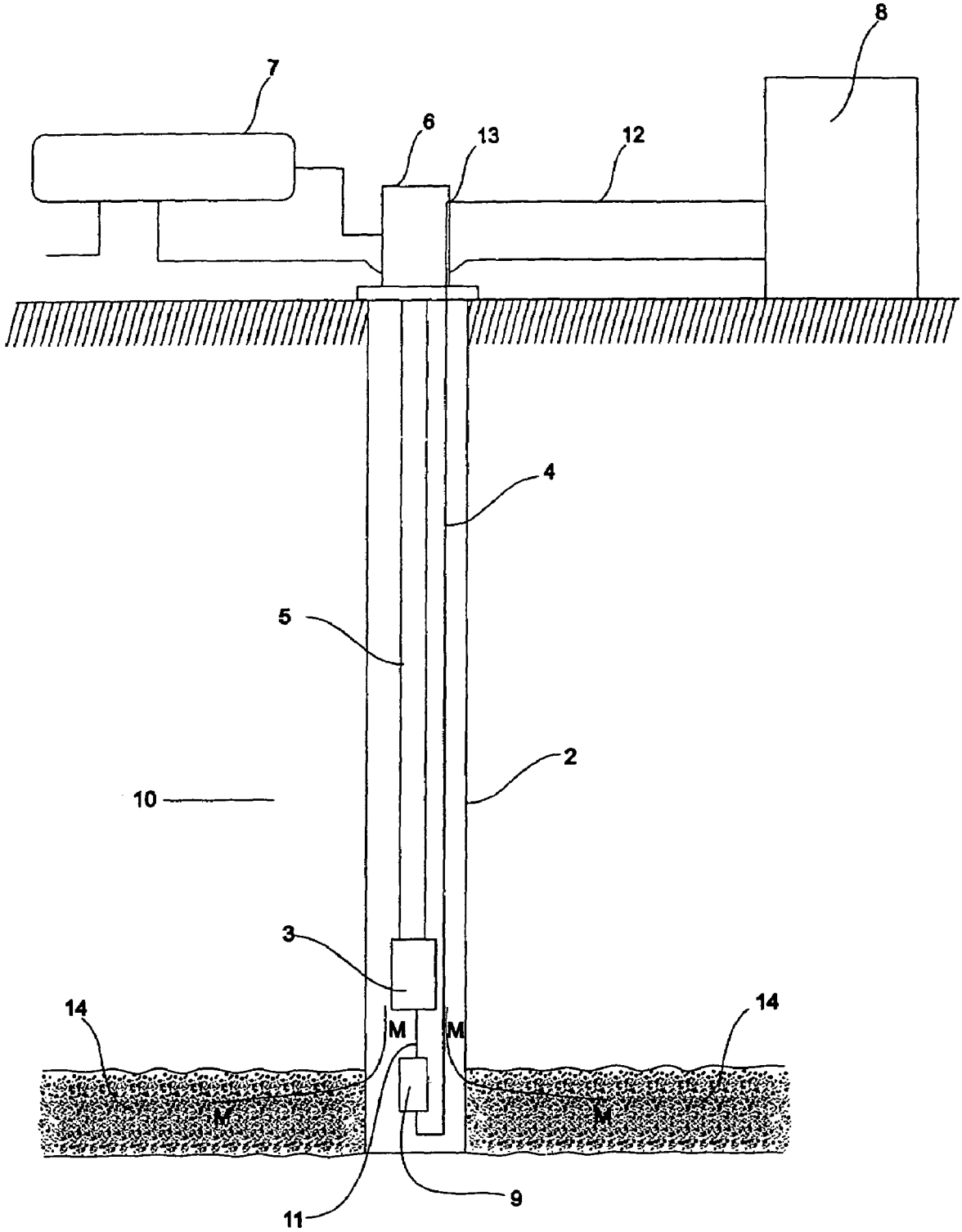
FIG. 4 illustrates a schematic representation of a first embodiment of a petroleum well equipped with the apparatus made subject to the instant invention.

In FIG. 4, a schematic representation of a first embodiment of a petroleum well, equipped with an apparatus made subject to the instant invention, is illustrated. It may be observed that the oil well 10 is provided with a casing 2 having a production tubing 5 installed in the interior thereof.

At some point in the production tubing 5, preferentially in its lower end, hydraulic pumping device 3 is provided. A Christmas tree 6, to which the production tubing 5 is connected, is installed on the surface.

The hydraulic pumping device 3 may be an ejector for use with a HJP, and may be in association with a hydraulic motor or a hydraulic turbine/rotative pump, for use with a SCP or a PCP or thereafter in conjunction with a hydraulic motor/alternative pump, for use with a HPP.

An injection pump 9 or an injection pump device, which will hereinafter be referenced, is positioned in the interior of the petroleum well 10, preferably below the hydraulic pumping device 3. A hydraulic fluid injection tubing 11 connects the discharge of the injection pump device 9 to the injection nozzle 61 of the ejector apparatus 80', in the case of the method utilized by being a HJP or in conjunction with a hydraulic motor or hydraulic turbine/rotative pump 70 in the case of SCP or of PCP or in conjunction with a hydraulic motor/alternative pump, in the case of HPP.

A hydraulic fluid suction tubing 4 is also provided in the interior of the casing 2. The casing 2, the production tubing 5 and the hydraulic fluid suction tubing 4 are connected at their upper ends to the Christmas tree 6. The hydraulic fluid suction tubing 4 connects the suction of the injection pump device 9 to the injection tubing connection point 13 on the Christmas tree 6. This injection tubing connection point 13 is connected to a tank of hydraulic fluid 8 by means of a hydraulic fluid connection tubing 12.

The hydraulic fluid is pumped by the injection pump device 9 from the hydraulic fluid tank 8 and through the hydraulic fluid suction tubing 4. Thereafter, the hydraulic fluid is directed through the hydraulic fluid injection tubing 11 to the hydraulic pumping device 3. From there, the hydraulic fluid is subject to the pumping action, produced by HJP, SCP, PCP or HPP, according to the mode of operation previously described for each of these methods. The fluids produced from the petroleum reservoir 14 mix thereafter with the hydraulic fluid and are conducted through the interior of the production tubing 5 to the Christmas tree 6 on the surface. Thereafter, this mixture of fluids is conducted to a separator vessel 7 where a separation of the fluids is effected. The hydraulic fluids are thereafter returned to the tank of hydraulic fluid 8 in order to be reused.

As may be observed, the arrangement illustrated in FIG. 4 is similar to the arrangement of an installation known in the art and illustrated in FIG. 1. The fundamental difference being the fact that the injection pumping device 9 is located in the bottom of the well 10, in proximity to the hydraulic pumping device 3, which carries great advantages as will be seen hereafter.

The essence of this embodiment is the relocation of the injection pumping device 9, which is normally installed on the surface, to the interior of the well. This will permit the operation of the injection system with pressures that are very much lower than those conventionally found in installations known in the art.

In this manner, safety is increased while the cost of the tubing which conveys hydraulic fluid to the injection pumping device 9 is decreased. In the case of the hydraulic fluid suction tubing 4, which now operates with pressures which are much lower than those normally known in the art, the wall thickness of such tubing may now be much thinner.

Even more so, the present invention renders viable applications of a method that would require the provision of hydraulic fluid to a hydraulic pumping device positioned at the bottom of the well (HJP, SCP, PCP, HPP) and in the case of having to employ installations known in the art, would require employing hydraulic fluid injection pressures so high that they would not be obtainable given the devices which presently exist on the market.

Preferentially, the injection pumping device 9 may be a centrifugal pump similar to those already used in the pumping of petroleum in the method of lifting known as submersible centrifugal pumping. This type of pump, also known as a submersible centrifugal pump, which may have a single stage or multiple stages, has an average operational use life of two years, due to wear on the axle and bearings, incrustation, corrosion, and erosion of the rotors.

Therefore, in tests conducted by the instant applicants, wherein a single phase hydraulic fluid, i.e. a fluid containing no gas, was used, it was observed that the durability of the submersible centrifugal pump was increased significantly.

This makes possible the use of submersible centrifugal pumps for periods which considerably exceed the average two year operational use life mentioned above, with the result that the proposed apparatus of the instant invention provides an economically viable alternative.

When one compares the proposed apparatus of the instant invention with submersible centrifugal pumping in which a submersible centrifugal pump would pump produced fluids from a reservoir towards the surface, it may be observed that in given situations the apparatus of the present invention defines advantages.

In the apparatus of the instant invention, the submersible centrifugal pump works with a fluid which is cleaner and free of gas, which results in a greater durability of the submersible centrifugal pump, as has already been mentioned. Moreover, with the use of the apparatus of the instant invention, the fluids produced from the reservoir are diluted in hydraulic fluid thereby yielding a mixture having a lower viscosity, which in turn, facilitates the flow of these fluids towards the surface.

In some cases, the use of only a submersible centrifugal pump may be impracticable, for example, in wells with very high ratios of gas and liquid or in those wells that produce extremely heavy oils. With the use of the apparatus of the instant invention, it would be possible to remove production from these types of wells without considerable problems.

Although the present invention preferentially utilizes a submersed centrifugal pump to operate as an injection pump, it should be clear that the invention is not limited to the use of this particular type of pump.

It should be mentioned that the arrangement illustrated in FIG. 4 may be used in land wells as well as in subsea wells. In this latter case, only some adaptations, of a type well known in the art, would be necessary in order to render the apparatus of the instant invention usable.

In the case of the Christmas tree for a subsea well being installed in a service unit, which may be either a fixed or a floating platform, a boat, or any other type of unit for the collection of produced fluids that may be positioned on the land, the basic arrangement would be the same as that illustrated in FIG. 4. In the case of utilizing a subsea Christmas tree, it would be only necessary to utilize a submersible tubing to connect the hydraulic fluid tank to the injection tubing connection point 13 of the subsea Christmas tree.

Figure 5:
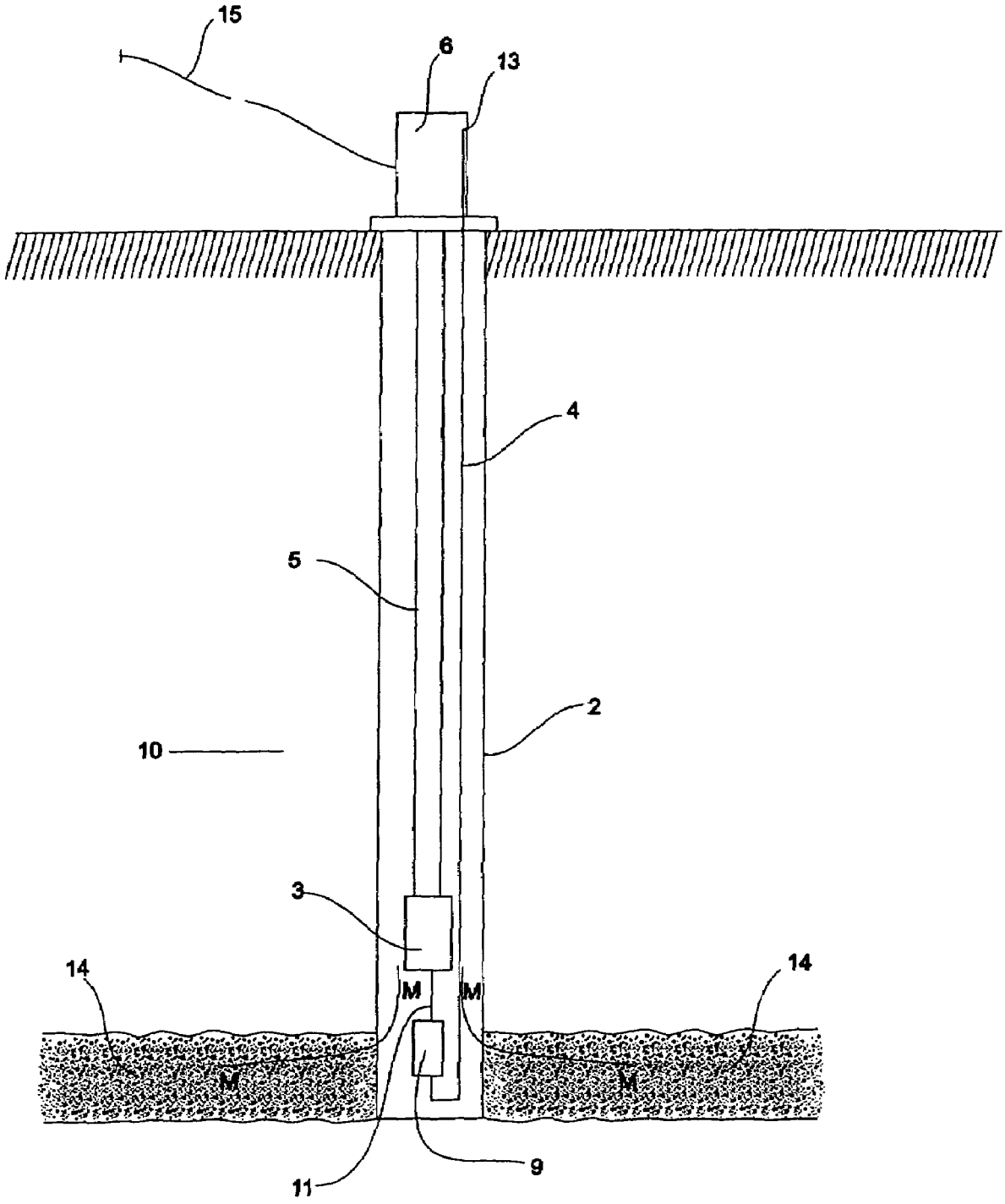
FIG. 5 illustrates a schematic representation of a second embodiment of the apparatus made subject to the instant invention.

In FIG. 5 a petroleum well, equipped with a second embodiment of the apparatus of the instant invention, is illustrated. This embodiment is similar to the embodiment of FIG. 4, with the difference being that in this embodiment, the Christmas tree is a subsea Christmas tree. It is similar to embodiment of FIG. 4 with the difference that in this embodiment, that the Christmas tree 6 is a subsea Christmas tree.

A significant difference between the embodiment of FIG. 5 and the embodiment of FIG. 4 resides in the fact that the injection fluid, in the case of seawater, is collected directly at the injection tubing connection point 13 in the Christmas tree 6 or proximate thereto. In this embodiment, the hydraulic fluid suction tubing 4 connects the injection tubing connection point 13 to the suction of the injection hydraulic device 9 and the sea itself would be the source of supply for the hydraulic fluid. In this case, the circuit of hydraulic fluid is open.

Therefore, the hydraulic fluid would already be admitted into the injection tubing connection point 13 at a considerable pressure, due to the static pressure of the column of water, which would reduce the required potential of the injection pump to pump the hydraulic fluid in the hydraulic pumping device.

In the embodiment of FIG. 5, the fluids originating from the reservoir of petroleum 14, mix with the seawater in the hydraulic pumping device 3 and this mixture of fluid is conducted to the Christmas tree 6. A conduction tubing 15 then conducts the mixture of fluids to the surface, where a separation of fluids is effected. The seawater is then separated from the mixture and is discarded, after undergoing treatment in a processing unit.

In this embodiment, it is not necessary to utilize a tubing in order to connect the reservoir of hydraulic fluid to the injection connection point in the Christmas tree 6 as in the embodiment of FIG. 4.

This creates the possibility of employing the tubing for other purposes. For example, the tubing may be used for the injection of gas into the ascending tubing (riser) that extends from the Christmas tree in the direction of a unit on the surface, in order to produce a reduction in the density of fluids that flow through this ascending tubing.

Another possibility would be that of using this tubing for injecting specific chemical products or even for the passage of cleaning elements (pigs).

Figure 6:
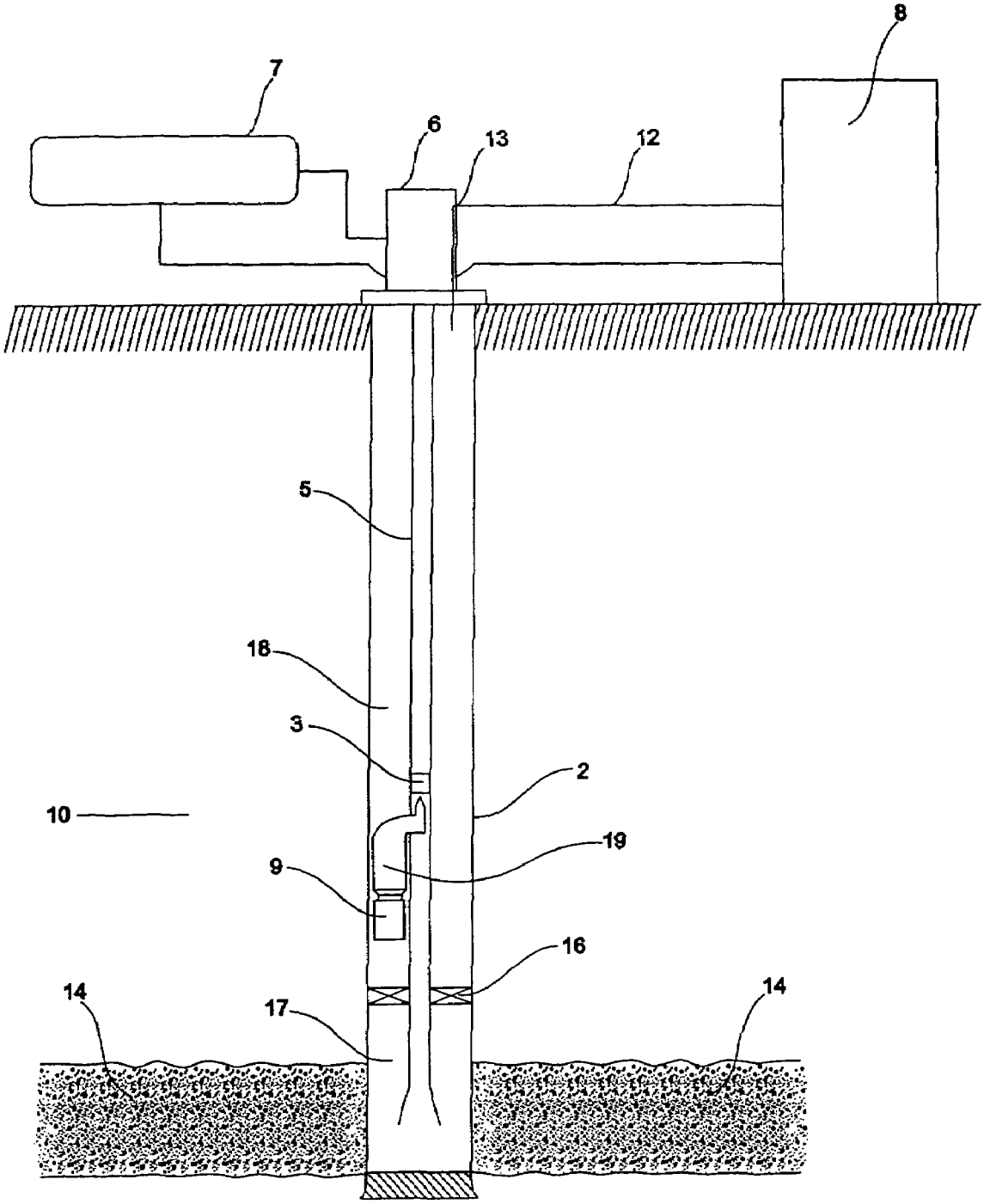
FIG. 6 illustrates a schematic representation of the third embodiment of the apparatus made subject to the instant invention.

In FIG. 6, a third embodiment of the apparatus of the instant invention is illustrated schematically. This embodiment may be used in a well, positioned on land or in the sea.

A packer 16 divides the interior of the casing 2 into two chambers, a lower chamber 17, filled by fluid originating from the petroleum reservoir 14 and another upper chamber 18 that corresponds to the annular space between the production tubing 5 and the casing 2 and above the packer 16.

In this embodiment, the upper chamber 18 is filled with hydraulic fluid, originating from a supply source of hydraulic fluid. As shown this source of supply of hydraulic fluid is a tank of hydraulic fluid 8, which is connected to the injection tubing connection point 13 of the Christmas tree 6 by way of a fluid injection conduction tubing 12.

A pump may be used to pump hydraulic fluid to the upper chamber 18. Moreover, though it should be understood that it is not necessary that this pump be capable of maintaining the hydraulic fluid under pressure in the interior of the upper chamber 18, since its function would only be to maintain the fluid in the interior of the upper superior chamber 18 at an adequate level.

The hydraulic fluid, resident in the upper chamber 18, is sucked by the suction of an injection pump device 9. Injection pump device has its discharge connected to a type of lateral connection 19 which is known in the art. This lateral connection 19 facilitates the hydraulic fluid, which is being pumped by the injection pumping device 9, to be directed to the hydraulic pumping device 3. Thereafter, the pumping action results from the action of a HJP, SCP, PCP, or HPP, consistent with the operations previously described for each of these respective methods.

It should be observed at this point that the static pressure of the column of hydraulic fluid in the interior of the upper chamber 18 would result in the hydraulic fluid entering the suction inlet of the injection pumping device 9 at a considerable pressure.

Figure 7:
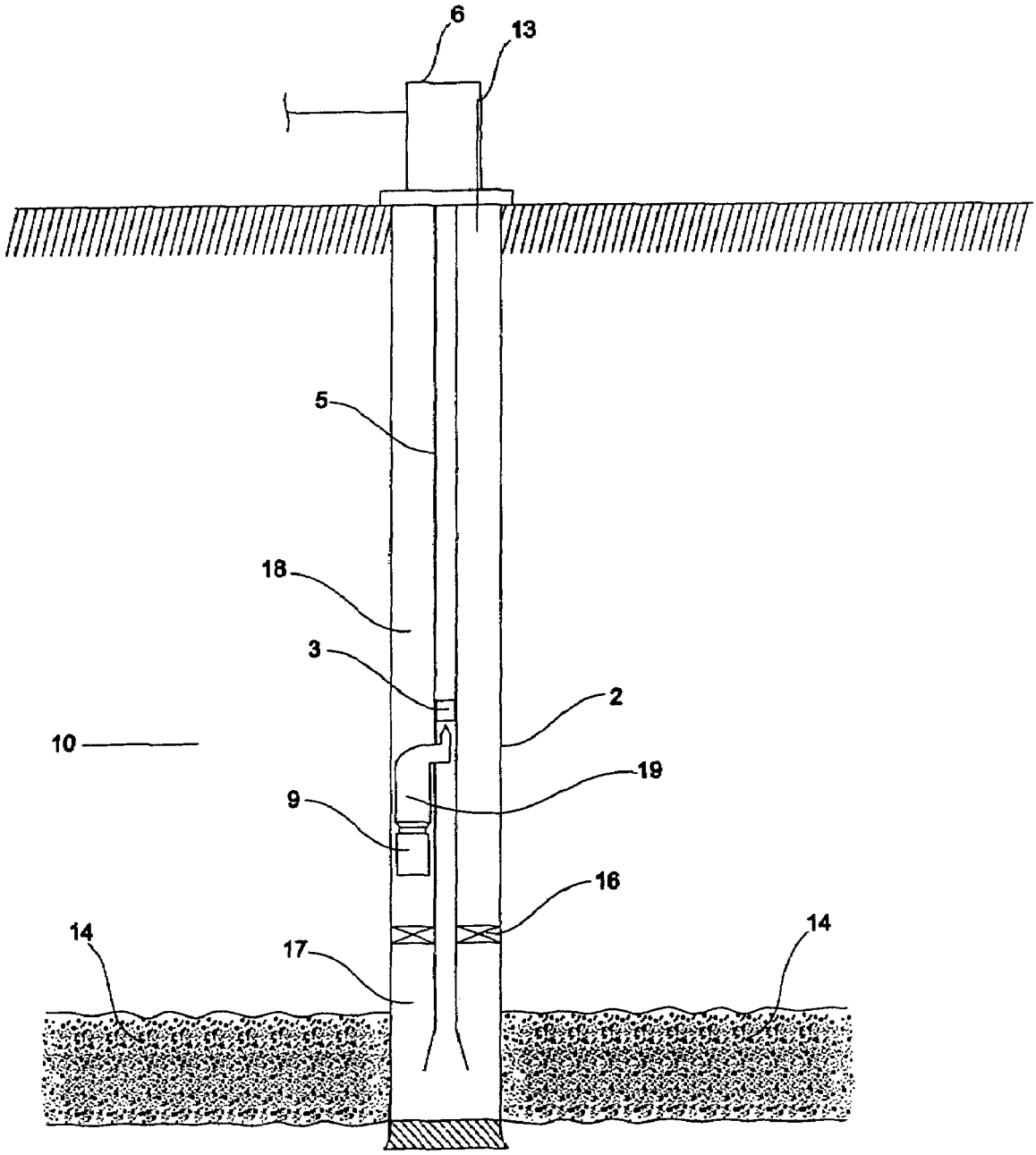
FIG. 7 illustrates a fourth embodiment of the apparatus made subject to the instant invention.

A fourth embodiment in the apparatus of the instant invention is shown in FIG. 7. In this embodiment, the Christmas tree 6 is a subsea Christmas tree and the hydraulic fluid being employed is seawater.

A significant difference between the embodiment of FIG. 7 and that of FIG. 6 is the fact that the injection fluid, in this case seawater, is collected at the injection tubing connection point 13 in the Christmas tree 6 or proximate thereto.

Given this construction, the hydraulic fluid would enter the injection tube connection point 13 at a considerable pressure due to the static pressure of the column of water, which would, in turn, reduce the required potential, required by the injection pump to pump the hydraulic fluid to the hydraulic pumping device.

The operation of the apparatus of the present invention, illustrated in FIG. 7, is identical to that which was described in relation to FIG. 6. In an effort to simplify the instant description, a description of that operation will not be repeated.

The present invention also contemplates ways of adjusting the flow of the injection fluid. For example, frequency variators, of the type known in the art, may be employed to alter the speed of rotation of the submersible centrifugal pump, thereby modifying, as a consequence, the flow rate. This capability confers considerable flexibility on the invention.

In some situations the injection pump device may be installed outside of the subsea well, for example, next to the Christmas tree. The injection pumping device may be connected to the subsea Christmas tree so as to form an integral structure.

Figure 8:
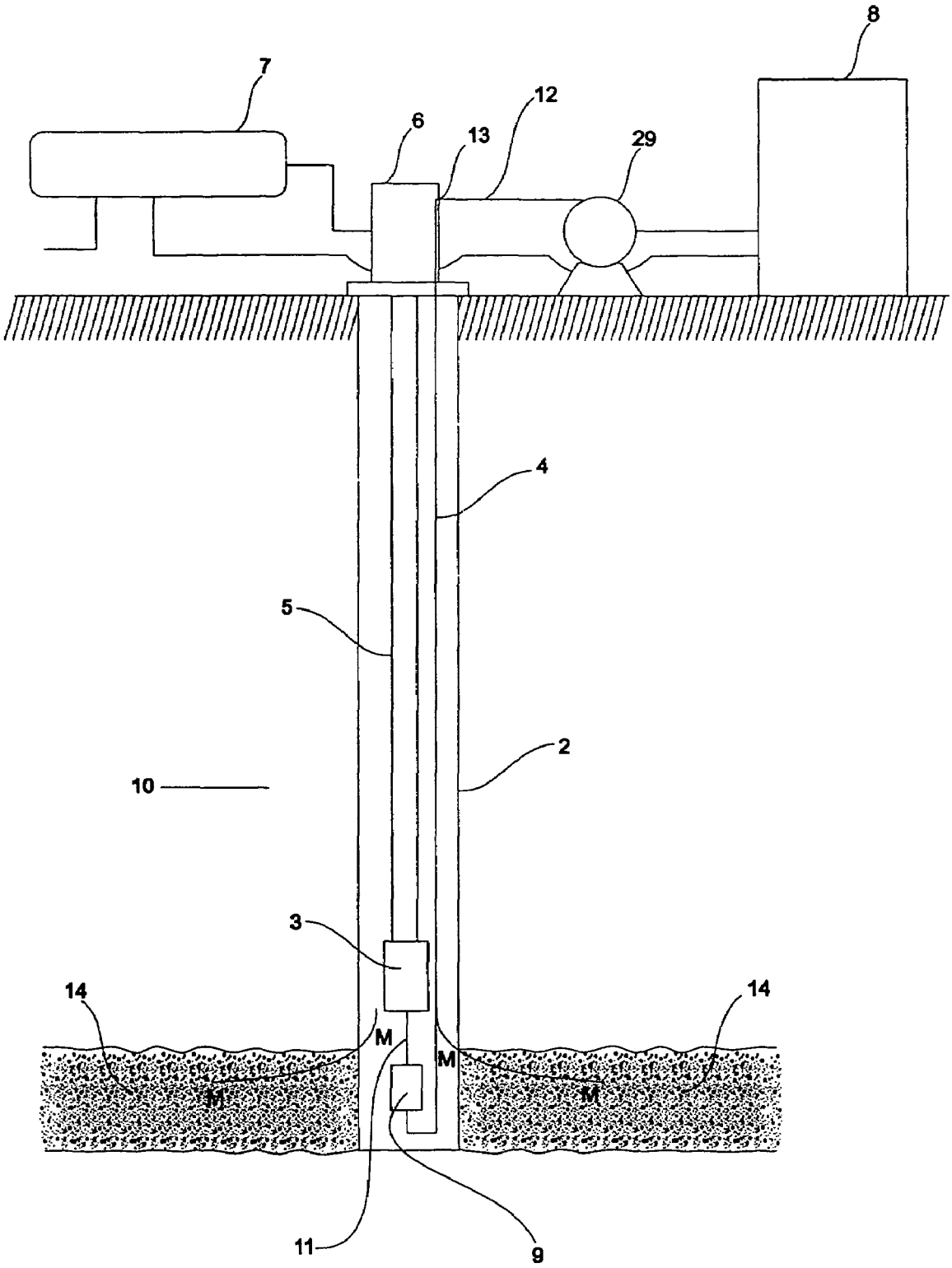
FIG. 8 illustrates a fifth embodiment of the apparatus made subject to the instant invention.

The fifth embodiment of the instant invention is illustrated in FIG. 8. In this construction a second injection pumping device 29 is provided to supply hydraulic fluid to the first injection pumping device 9, which is installed in the interior of the petroleum well 10, in proximity to hydraulic pumping device 3.

The second injection pumping device 29 is installed outside of the petroleum well 10 and is positioned in proximity to a Christmas tree 6, which is installed at the wellhead of the petroleum well 10. The discharge outlet of the second injection pumping device 29 is connected to the injection tubing connection point 13 of the Christmas tree 6 by way of injection fluid conduction tubing 32. A hydraulic fluid injection tubing 4 connects the injection tubing connection point to the first injection pumping device 9.

The hydraulic fluid, which is sucked by the second injection pumping device 29, flows through the injection fluid conduction tubing 12 and thereafter through hydraulic fluid injection tubing 4 to first injection pumping device 9 and thereafter to the hydraulic pumping device 3. The pumping action produced by HJP, SCP, PCP or HPP, then acts on the hydraulic fluid in the manner previously described for each of these methods.

In this construction, the use of a second injection pumping device 29 to provide hydraulic fluid to the first injection pumping device 9, at a pressure substantially higher than that found in constructions wherein a second injection pumping device 29 is not used may be substantially advantageous.

It should be observed at this point that a second injection pumping device 29 may be used to provide hydraulic fluid to the first injection pumping device 9 at a pressure which does not require the use of a special hydraulic fluid suction tubing 4 capable of containing high pressures.

This is due to the fact that the purpose of this embodiment permits the first injection pumping device 9 to operate with an upstream pressure which is higher than encountered in constructions which do not utilize a second injection pumping device 29. Furthermore, this construction facilitates the use of hydraulic fluid suction tubing which is not special order and therefore readily available on the market.

The installation of the second injection pumping device 29 in the manner illustrated in FIG. 8 is simpler and cheaper, with the added advantage of having the most critical part of the injection system operating at pressures within acceptable values.

Figure 9:
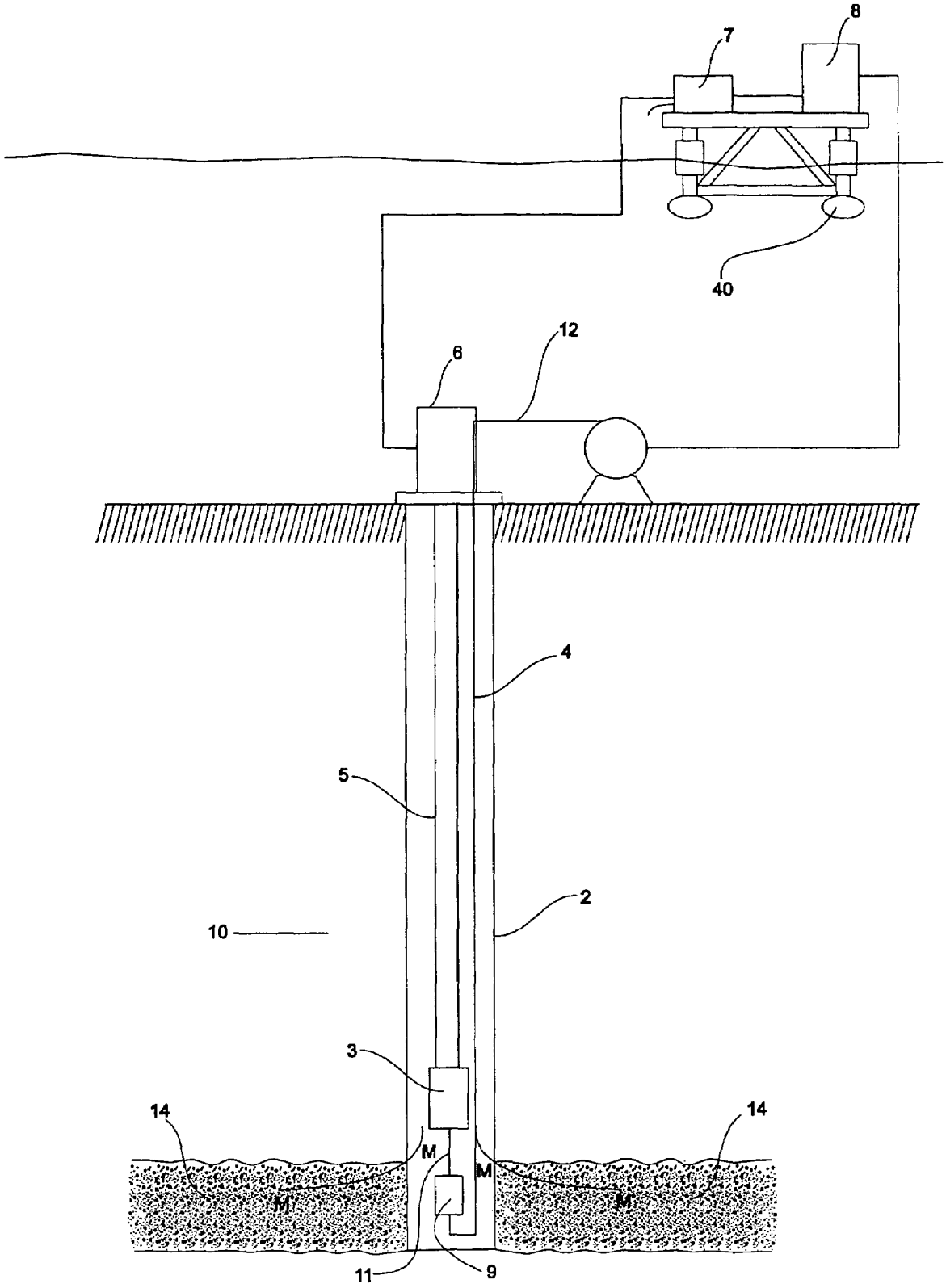
FIG. 9 illustrates a sixth embodiment of the apparatus made subject to the instant invention.

A sixth embodiment of the apparatus made subject to the instant invention is illustrated in FIG. 9. In this embodiment injection pumps, installed in series, are also utilized. The difference between the embodiment of FIG. 9 and the embodiment of FIG. 8 is that the petroleum well of the embodiment of FIG. 9 is a subsea well and the second injection pumping device 29 sucks hydraulic fluid from the tank of hydraulic fluid 8 on the surface, in a service unit 40.

The hydraulic fluid is pumped by a second injection pumping device 29 from the hydraulic fluid tank 8 to a first injection pumping device 9, through the hydraulic fluid suction tubing 4, and thereafter through the hydraulic fluid injection tubing 11 to the hydraulic pumping device 3. From there, the pumping action produced by HJP, SCP, PCP, or HPP, in the manner previously described for each of these methods, acts upon the hydraulic fluid.

The fluids, produced from the petroleum reservoirs 14, then mix with the hydraulic fluid. The mixed fluids then flow through the interior of the production tubing 5 to the Christmas tree 6. Thereafter, this mixture of fluids passes through a separator vessel 7 positioned on the surface, in the service unit 40, wherein a separation of fluids is effected. The hydraulic fluid is then returned to the tank of hydraulic fluid 8 in order to be reused.

Figure 10:
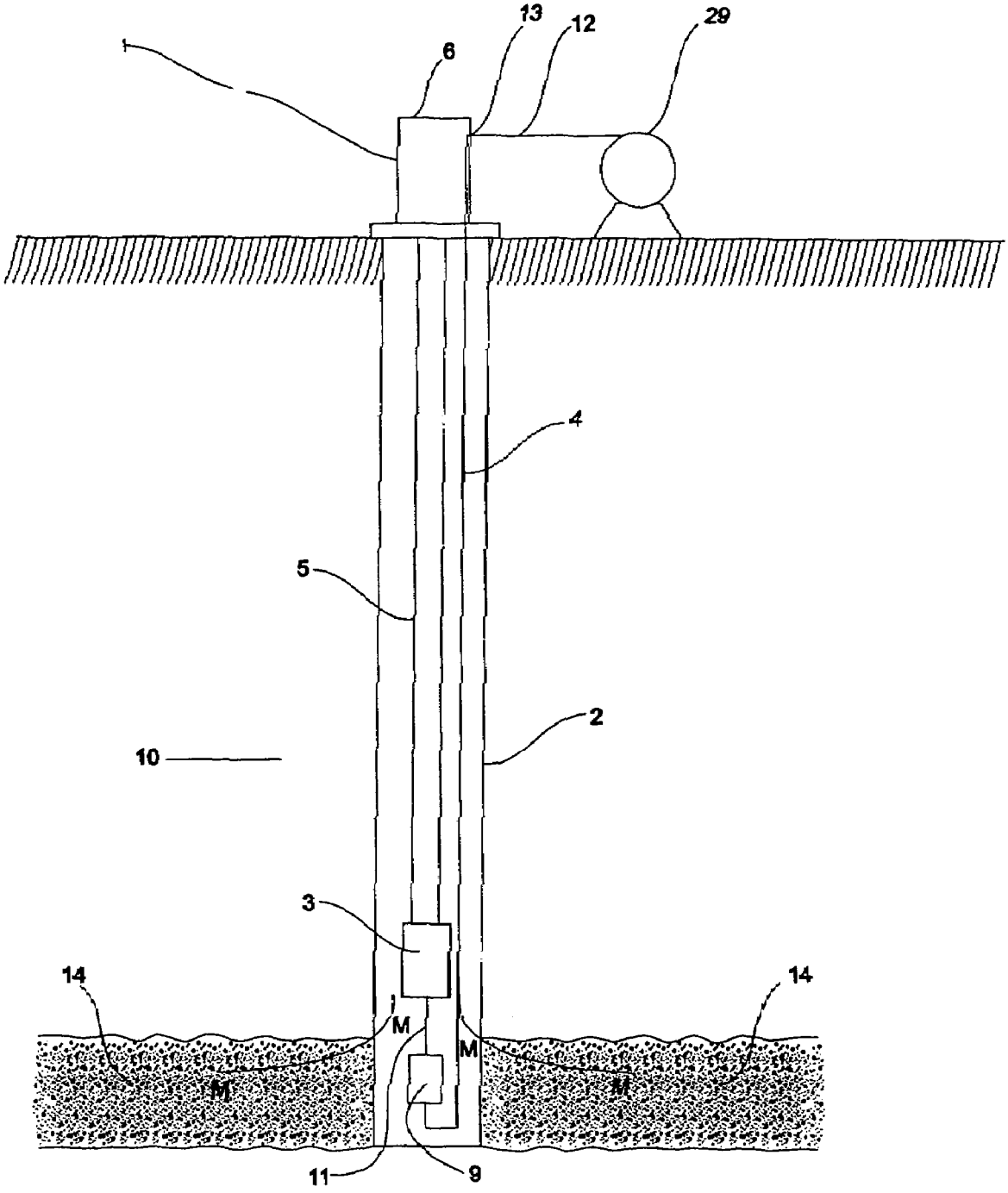
FIG. 10 illustrates a seventh embodiment of the apparatus made subject to the instant invention.

A seventh embodiment of the apparatus of the instant invention is illustrated in FIG. 10. This embodiment also utilizes injection pumps installed in series. A significant difference between the embodiment of FIG. 10 and the embodiment of FIG. 9 is that in the embodiment of FIG. 10 a second injection pump device 29 sucks water from the sea and thereafter this water is utilized as the hydraulic fluid.

In this embodiment, the second injection pumping device 29 is a pump whose external portion operates in contact with sea water. Although in FIG. 9 a second injection pumping device 29 is illustrated in a configuration wherein it is separated from the Christmas tree 6, nothing precludes this second injection pumping device 29 from being mounted in conjunction with a Christmas tree 6, such that these two devices form an integral structure.

A disadvantage of the embodiments of FIGS. 9 and 10 results from the fact that the second injection pumping device 29 must operate in the severe conditions encountered on the sea bed floor. While such devices are known in the art, this solution, besides being expensive, would require new developments for its implementation, to increase the level of confidence in this device.

Figure 11:
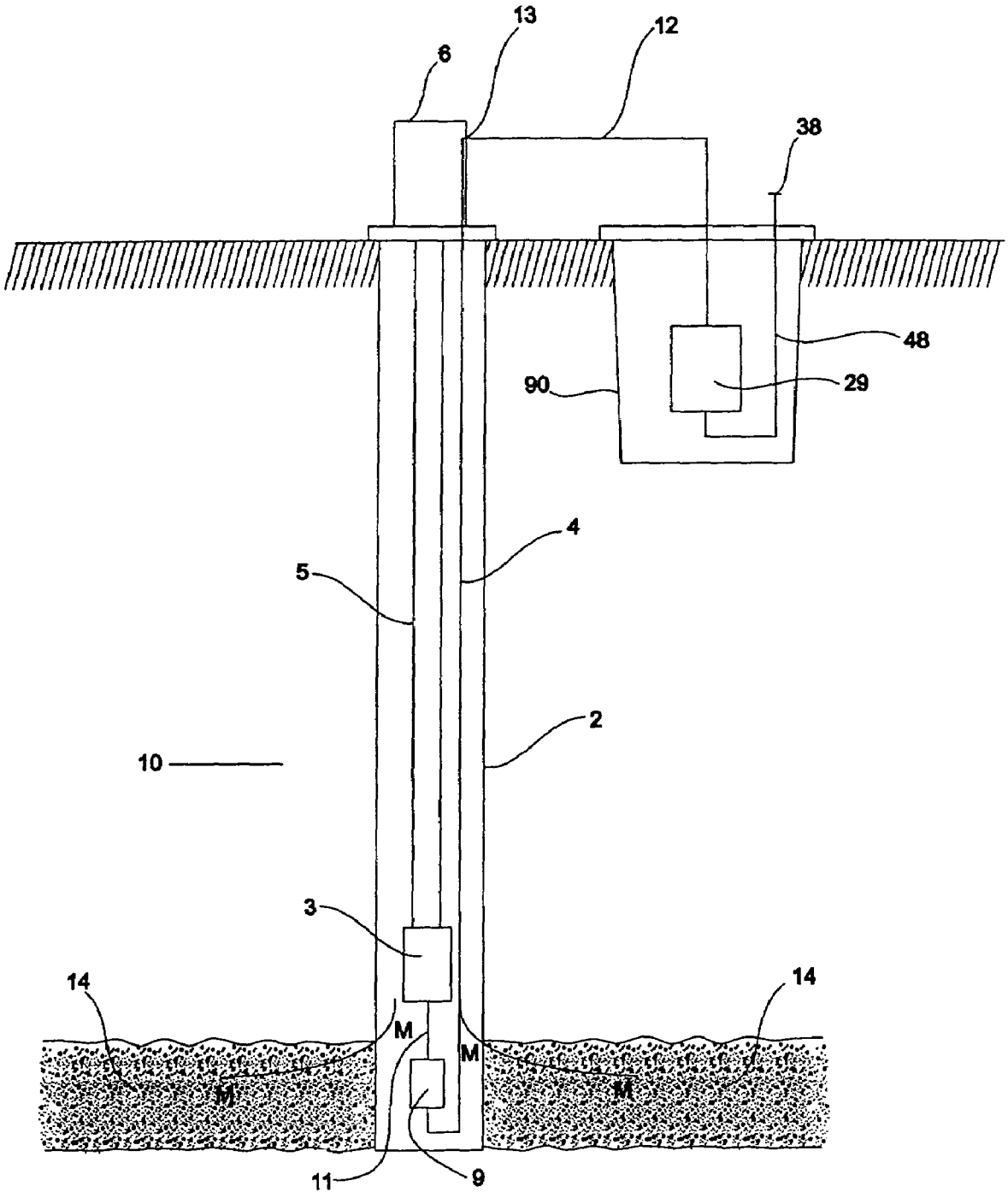
FIG. 11 illustrates an eighth embodiment of the apparatus made subject to the instant invention.

An eighth embodiment of the apparatus of the instant invention is illustrated in FIG. 11, which is similar to the embodiment of FIG. 10. In this embodiment, the second injection pumping device 29 is mounted in the interior of an auxiliary well 90. It is not necessary that the second injection pumping device 29 be a pump whose external portion operates in direct contact with seawater. In this construction, seawater is collected toward the interior of the auxiliary well 90, through a collection connection 38. A connection tubing 48 connects the collection connection 38 to a second injection pumping device 29.

This substantially reduces the costs of installation, in that pumps having an external portion which operates in direct contact with seawater are substantially more expensive. In the instant embodiment, one may use, for example, an axial centrifugal pump, similar to those which are used as submersible centrifugal pumps, which are significantly less expensive.

Figure 12:
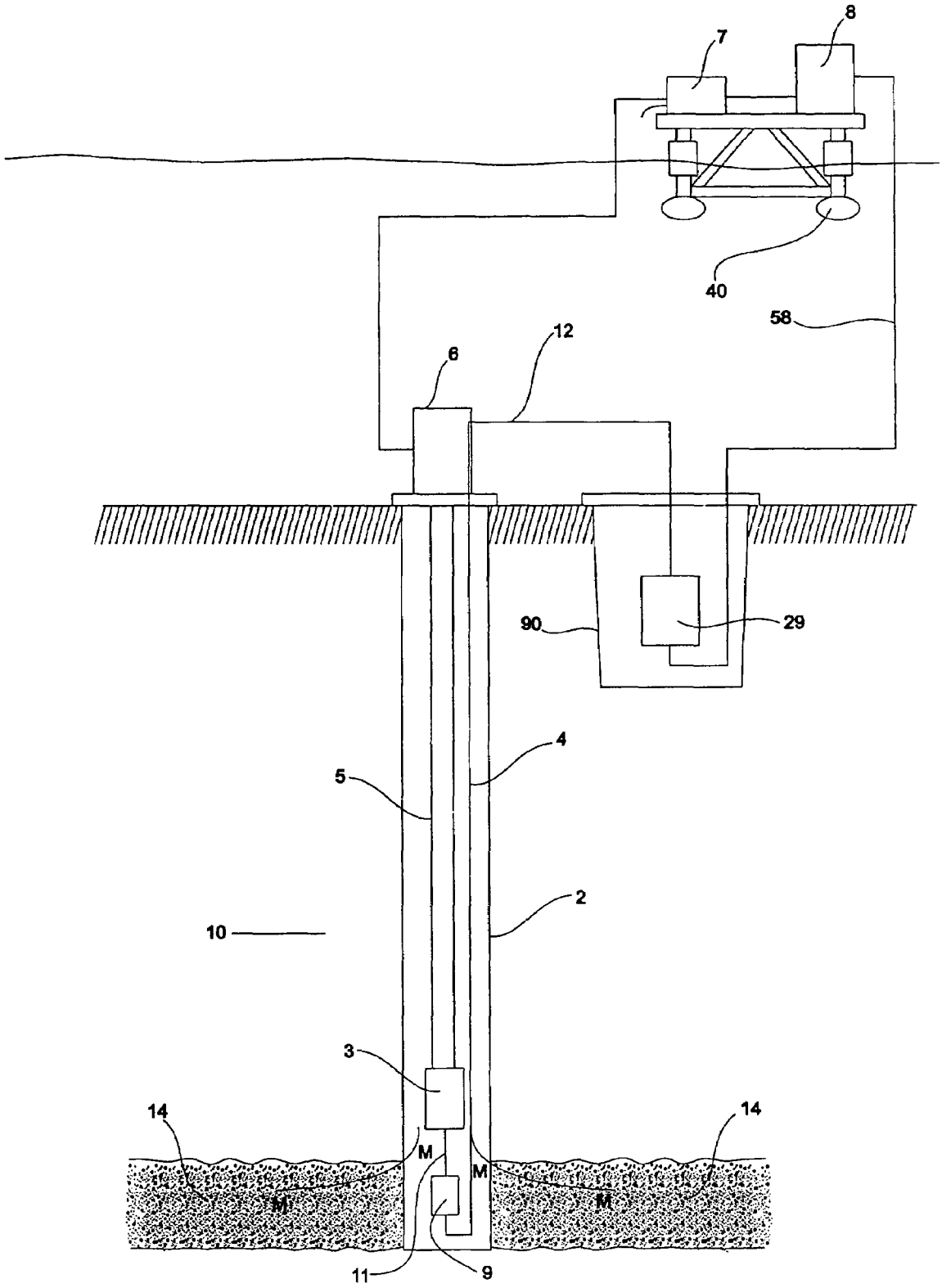
FIG. 12 illustrates a ninth embodiment of the apparatus made subject to the instant invention.

A ninth embodiment of the apparatus of the instant invention is illustrated in FIG. 12. In this embodiment, a second injection pumping device 29, positioned in the interior of an auxiliary well 90, operates to suck hydraulic fluid from a tank of hydraulic fluid 8 positioned in a service unit 40, on the surface, as illustrated in FIG. 12. Suction tubing 58 connects the tank of hydraulic fluid 8 to a second injection pumping device 29.

It should be observed, that in spite of the fact that reference in the instant specification has been limited to the use of only one injection pumping device, installed in the interior of the petroleum well, nothing precludes the use of a plurality of such pumping devices, installed in series. In this case, this component would be better denominated as a first injection pumping device, wherein such a device would include, at a minimum, at least one injection pumping device.

In a similar vein, nothing precludes the use of a plurality of injection pumps, installed in series, as a means of supplying hydraulic fluid at higher pressure levels to the first injection pumping device, installed in the interior of a petroleum well similar, as was previously described with reference to the embodiments of FIGS. 8 to 11.

Furthermore, there may be situations in which it may be necessary to install a third injection pumping device in the service unit 40, for example, to provide hydraulic fluid at high pressure to a second injection pumping device 29. In this case, this component would be better denominated as a second injection pump device which would in clued, at minimum, at least one injection pump device.

The number of pumps to be employed within the interior of the well, as well as outside of the well, will depend on a number of actors including: the characteristics of the hydraulic fluid, the nature of the fluid to be pumped, the depth at which the subsea well is to be installed, the depth at which the pump is installed in the interior of the petroleum well, etc., The well system manager will make the choice of pump in order to best attend to the necessities at hand.

Figure 13:
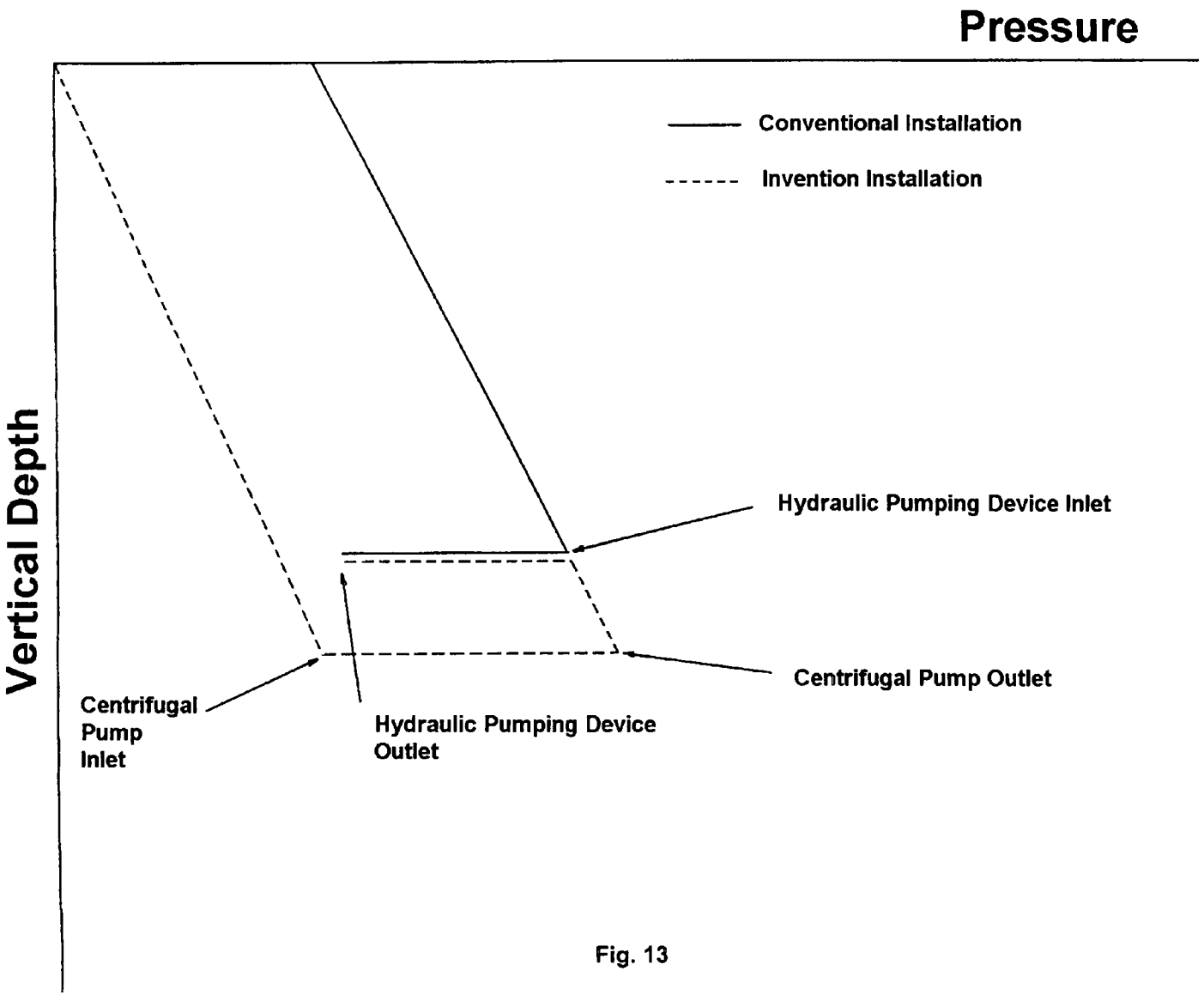
FIG. 13 illustrates a graph which represents, in schematic form, the profile of pressures in a well thereby facilitating a comparison between a conventional installation and the apparatus made subject to the instant invention.

In FIG. 13 the illustrated graph presents, in a schematic form, the profile of pressures in a well. The graph provides a comparison between a conventional installation and the apparatus made subject to the instant invention.

The continuous line represents the profile of pressures that normally occur in the injection line of a hydraulic fluid in a conventional installation. The broken line represents a profile of pressures in an installation that utilizes the proposed solution of the present invention. As may be observed in FIG. 10, the system of the present invention is subjected to pressures which are dimensionally lower for almost all of the depths. These results indicate that the instant invention does not require the use of special tubing to transfer the hydraulic fluid.

The invention herein has been described with reference to preferred embodiments. It should be mentioned, however, that the invention is not limited to these embodiments in that those skilled in the art will perceive that the basic principles of the invention may be applied in diverse manners to constructions beyond those which have been presented herein without thereby departing from the concepts of the invention. Therefore, the invention is only limited to the content of the claims annexed to the instant specification.

What is claimed is:

1. An apparatus for the production of a subsea petroleum well wherein fluids originating from a reservoir flow toward the interior of said petroleum well, said well comprising:

a Christmas tree;

a casing whose upper end is connected to said Christmas tree;

a production tubing installed in the interior of said casing whose upper end is connected to said Christmas tree;

hydraulic pumping device connected to the lower end of said production tubing;

said apparatus characterized by:

first injection pumping device connected to a source of supply of hydraulic fluid, said first injection pumping device positioned in the interior of said petroleum well) in order to provide hydraulic fluid to said hydraulic pumping device;

a hydraulic fluid injection tubing, which connects the discharge of said first injection pumping device to said hydraulic pumping device;

wherein, said hydraulic fluid provided by said first injection pumping device to said hydraulic pumping device causes a pumping effect, in the interior of said production tubing on the fluids, originating from the reservoir, in the direction of said Christmas tree.

2. The apparatus according to claim 1, characterized by:

said Christmas tree being provided with an injection tubing connection point;

said source of supply of hydraulic fluid being a tank of hydraulic fluid which is connected to said injection tubing connection point; and a hydraulic fluid suction tubing positioned in the interior of said casing to connect said injection tubing connection point to suction of said first injection pumping device.

3. The apparatus according to claim 1, characterized by:

said Christmas tree being a subsea Christmas tree, which is provided with an injection tubing connection point;

said hydraulic fluid being seawater;

said hydraulic fluid being collected in said injection tubing connection point; and a hydraulic fluid suction tubing positioned in the interior of said casing to connect said injection tubing connection point to suction of said first injection pumping device.

4. An apparatus for the production of a subsea petroleum well wherein fluids originating from a reservoir flow toward the interior of said petroleum well, said well comprising:

a Christmas tree;

a casing whose upper end is connected to said Christmas tree;

a production tubing installed in the interior of said casing whose upper end is connected to said Christmas tree;

hydraulic pumping device (3) connected to the lower end of said production tubing;

said apparatus characterized by:

first injection pumping device connected to a source of supply of hydraulic fluid, said first injection pumping device positioned in the interior of said petroleum well in order to provide hydraulic fluid to said hydraulic pumping device;

a hydraulic fluid injection tubing, which connects the discharge of said first injection pumping device to said hydraulic pumping device;

wherein, said hydraulic fluid provided by said first injection pumping device to said hydraulic pumping device causes a pumping effect, in the interior of said production tubing on the fluids, originating from the reservoir, in the direction of said Christmas tree, said Christmas tree is provided with an injection tubing connection point;

said source of supply of hydraulic fluid is a tank of hydraulic fluid;

a second injection pumping device is provided, positioned outside of said petroleum well whose suction is connected to said tank of hydraulic fluid and whose discharge is connected to said injection tubing connection point; and a hydraulic fluid suction tubing, positioned in the interior of said casing to connect said injection tubing connection point to suction of said first injection pumping device.

5. The apparatus according to claim 4, characterized by:

said Christmas tree being a subsea Christmas tree, provided with said injection tubing connection point;

said tank of hydraulic fluid being located on the surface in a service unit; and an external portion of said second injection pumping device operating in contact with the water from the sea, in proximity to said Christmas tree.

6. An apparatus for the production of a subsea petroleum well wherein fluids originating from a reservoir flow toward the interior of said petroleum well, said well comprising:

a Christmas tree;

a casing whose upper end is connected to said Christmas tree;

a production tubing installed in the interior of said casing) whose upper end is connected to said Christmas tree;

hydraulic pumping device connected to the lower end of said production tubing;

said apparatus characterized by:

first injection pumping device connected to a source of supply of hydraulic fluid, said first injection pumping device positioned in the interior of said petroleum well in order to provide hydraulic fluid to said hydraulic pumping device;

a hydraulic fluid injection tubing, which connects the discharge of said first injection pumping device to said hydraulic pumping device;

wherein, said hydraulic fluid provided by said first injection pumping device to said hydraulic pumping device causes a pumping effect, in the interior of said production tubing on the fluids, originating from the reservoir, in the direction of said Christmas tree wherein the Christmas tree is a subsea Christmas tree, having an injection tubing connection point the hydraulic fluid is sea water;

a second injection pump device, is positioned outside of the petroleum well, whose external portion operates in contact with the water from the sea;

further comprising a second injection pumping device which sucks sea water;

the discharge of said second injection pump device) being connected to the injection tubing connection point; and a hydraulic fluid suction tubing, positioned in the interior of said casino to connect said injection tubing connection point to suction of said first injection pumping device.

7. An apparatus for the production of a subsea petroleum well wherein fluids originating from a reservoir flow toward the interior of said petroleum well, said well comprising:

a Christmas tree;

a casing whose upper end is connected to said Christmas tree;

a production tubing installed in the interior of said casing) whose upper end is connected to said Christmas tree;

hydraulic pumping device connected to the lower end of said production tubing;

said apparatus characterized by:

first injection pumping device connected to a source of supply of hydraulic fluid, said first injection pumping device positioned in the interior of said petroleum well in order to provide hydraulic fluid to said hydraulic pumping device;

a hydraulic fluid injection tubing, which connects the discharge of said first injection pumping device to said hydraulic pumping device;

wherein, said hydraulic fluid provided by said first injection pumping device to said hydraulic pumping device causes a pumping effect, in the interior of said production tubing on the fluids, originating from the reservoir, in the direction of said Christmas tree wherein said Christmas tree is provided with an injection tubing connection point said source of supply of hydraulic fluid is a tank of hydraulic fluid which is connected to said injection tubing connection point;

a packer is employed to divide the interior of said casing in two chambers;

a lower chamber which receives fluid provided from said reservoir; and an upper chamber which corresponds to the annular space between said production tubing and said casing which is filled with hydraulic fluid originating from said tank of hydraulic fluid;

said first injection pumping device suctioning hydraulic fluid from said upper chamber;

the discharge of said first injection pumping device is connected to a lateral connection in order that said hydraulic fluid pumped by said first injection pumping device is directed to said hydraulic pumping device.

8. An apparatus for the production of a subsea petroleum well wherein fluids originating from a reservoir flow toward the interior of said petroleum well, said well comprising:

a Christmas tree;

a casing whose upper end is connected to said Christmas tree;

a production tubing installed in the interior of said casing) whose upper end is connected to said Christmas tree;

hydraulic pumping device connected to the lower end of said production tubing;

said apparatus characterized by:

first injection pumping device connected to a source of supply of hydraulic fluid, said first injection pumping device positioned in the interior of said petroleum well in order to provide hydraulic fluid to said hydraulic pumping device;

a hydraulic fluid injection tubing, which connects the discharge of said first injection pumping device to said hydraulic pumping device;

wherein, said hydraulic fluid provided by said first injection pumping device to said hydraulic pumping device causes a pumping effect, in the interior of said production tubing on the fluids, originating from the reservoir, in the direction of said Christmas tree wherein said Christmas tree is a subsea Christmas tree, which is provided with an injection tubing connection point;

said hydraulic fluid is seawater;

a packer is employed to divide the interior of said casing into two chambers;

a lower chamber, which receives fluids originating from said reservoir; and an upper chamber, which corresponds to the annular space between said production tubing and said casing, which is filled with hydraulic fluid originating from said tank of hydraulic fluid said first injection pumping device operates to suck hydraulic fluid from said upper chamber;

the discharge of said first injection pumping device being connected to a lateral connection in order that said hydraulic fluid pumped by said first injection pumping device is conducted to said hydraulic pumping device.

9. An apparatus for the production of a subsea petroleum well wherein fluids originating from a reservoir flow toward the interior of said petroleum well, said well comprising:

a Christmas tree;

a casing whose upper end is connected to said Christmas tree;

a production tubing installed in the interior of said casing) whose upper end is connected to said Christmas tree;

hydraulic pumping device connected to the lower end of said production tubing;

said apparatus characterized by:

first injection pumping device connected to a source of supply of hydraulic fluid, said first injection pumping device positioned in the interior of said petroleum well in order to provide hydraulic fluid to said hydraulic pumping device;

a hydraulic fluid injection tubing, which connects the discharge of said first injection pumping device to said hydraulic pumping device;

wherein, said hydraulic fluid provided by said first injection pumping device to said hydraulic pumping device causes a pumping effect, in the interior of said production tubing on the fluids, originating from the reservoir, in the direction of said Christmas tree wherein said Christmas tree is a subsea Christmas tree, which is provided with an injection tubing connection point;

said hydraulic fluid is seawater;

a second injection pumping device, is positioned outside of said petroleum well, which operates in the interior of an auxiliary well;

a second injection pumping device for sucking water from the sea;

a discharge of said second injection pumping device being connected to said injection tubing connection point; and a hydraulic fluid suction tubing, positioned in the interior of said casing to connect said injection tubing connection point to suction of said first injection pumping device.

10. An apparatus for the production of a subsea petroleum well wherein fluids originating from a reservoir flow toward the interior of said petroleum well, said well comprising:

a Christmas tree;

a casing whose upper end is connected to said Christmas tree;

a production tubing installed in the interior of said casing) whose upper end is connected to said Christmas tree;

hydraulic pumping device connected to the lower end of said production tubing;

said apparatus characterized by:

first injection pumping device connected to a source of supply of hydraulic fluid, said first injection pumping device positioned in the interior of said petroleum well in order to provide hydraulic fluid to said hydraulic pumping device;

a hydraulic fluid injection tubing, which connects the discharge of said first injection pumping device to said hydraulic pumping device;

wherein, said hydraulic fluid provided by said first injection pumping device to said hydraulic pumping device causes a pumping effect, in the interior of said production tubing on the fluids, originating from the reservoir, in the direction of said Christmas tree wherein said Christmas tree is a subsea Christmas tree, which is provided with an injection tubing connection point said source of supply of hydraulic fluid is a tank of hydraulic fluid;

a second injection pumping device, is positioned outside of said petroleum well which operates in the interior an auxiliary well, whose suction is connected to said tank of hydraulic fluid and whose discharge is connected to said injection tubing connection point; and a hydraulic fluid suction tubing, is positioned in the interior of said casing to connect said injection tubing connection point to suction of said first injection pumping device.

11. The apparatus according to claims 9 or 10, characterized by said second injection pumping device being a submersible, centrifugal pump.

12. The apparatus according to one of claims 4-8, 9 and 10, wherein a system of pumping, employed in said hydraulic pumping device, is selected from the group consisting of a hydraulic jet pump, a submersible centrifugal pump, a progressive cavity pump, and a hydraulic piston pump.

13. The apparatus according to claim 12, wherein a system of pumping, employed in said hydraulic pumping device, is selected from the group consisting of a hydraulic jet pump, a submersible centrifugal pump, a progressive cavity pump, and a hydraulic piston pump.

14. The apparatus according to one of claims 4-8, 9 and 10 characterized by said first injection pumping device being a submersible centrifugal pump.

15. A method for the production of a petroleum well, in which fluids, originating from a reservoir, flow toward the interior of said petroleum well, which is provided with:

a Christmas tree;

a casing whose upper end is connected to said Christmas tree;

a production tubing installed in the interior of said casing whose upper end is connected to said Christmas tree;

hydraulic pumping device connected to the lower end of said production tubing;

first injection pumping device connected to a source of supply of hydraulic fluid, said first injection pumping device being positioned in the interior of said petroleum well in order to provide hydraulic fluid to said hydraulic pumping device;

a hydraulic fluid injection tubing which connects the discharge of said first injection pumping device to said hydraulic pumping device;

said method characterized by the following steps:

providing hydraulic fluid for the suction of said first injection pumping device;

causing said first injection pumping device to pump hydraulic fluid to said hydraulic pumping device;

such that said hydraulic fluid, provided by said first injection pumping device to said hydraulic pumping device causes a pumping effect in the interior of said production tubing, of fluids originating from said reservoir), said hydraulic fluid mixing with said fluids originating from said reservoir), said mixture of fluids being directed in the direction of said Christmas tree.

16. The method for the production of a petroleum well according to claim 15, characterized by the hydraulic fluid being seawater.

17. The method for the production from a petroleum well according to claim 15 wherein a system of pumping, utilized in said hydraulic pumping device, is selected from the group consisting of a hydraulic jet pump, a submersible centrifugal pump, a progressive cavity pump, and a hydraulic piston pump.

18. A method for the production of a petroleum well, in which fluids, originating from a reservoir, flow toward the interior of said petroleum well, which is provided with:

a Christmas tree;

a casing whose upper end is connected to said Christmas tree;

a production tubing installed in the interior of said casing whose upper end is connected to said Christmas tree;

hydraulic pumping device connected to the lower end of said production tubing;

first injection pumping device connected to a source of supply of hydraulic fluid, said first injection pumping device being positioned in the interior of said petroleum well in order to provide hydraulic fluid to said hydraulic pumping device;

a hydraulic fluid injection tubing which connects the discharge of said first injection pumping device to said hydraulic pumping device;

said method characterized by the following steps:

providing hydraulic fluid for the suction of said first injection pumping device;

causing said first injection pumping device to pump hydraulic fluid to said hydraulic pumping device;

such that said hydraulic fluid, provided by said first injection pumping device to said hydraulic pumping device causes a pumping effect in the interior of said production tubing, of fluids originating from said reservoir, said hydraulic fluid mixing with said fluids originating from said reservoir, said mixture of fluids being directed in the direction of said Christmas tree further characterized by the step of providing hydraulic fluid for the suction of said first injection pumping device including the use of second injection pumping device, positioned outside of said petroleum well, which provides hydraulic fluid to the suction of said first injection pumping device.

19. The method for the production of a petroleum well according to claim 18, characterized by the hydraulic fluid being seawater.

20. The method for the production from a petroleum well according to claim 18, wherein a system of pumping, utilized in said hydraulic pumping device, is selected from the group consisting of a hydraulic jet pump, a submersible centrifugal pump, a progressive cavity pump, and a hydraulic piston pump.

* * * * *

UNITED STATES PATENT AND TRADEMARK OFFICE

CERTIFICATE OF CORRECTION

PATENT NO. : 7,594,543 B2
APPLICATION NO. : 10/918282
DATED : September 29, 2009
INVENTOR(S) : Goncalves et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 965 days.

Signed and Sealed this

Twenty-eighth Day of September, 2010

David J. Kappos

David J. Kappos
*Director of the United States Patent and Trademark Office*